US006345522B1

(12) United States Patent
Stillwagon et al.

(10) Patent No.: US 6,345,522 B1
(45) Date of Patent: Feb. 12, 2002

(54) ELECTRO-MECHANICAL LATCHING APPARATUS

(75) Inventors: Woodrow C. Stillwagon, Atlanta, GA (US); Jean L. Meeks, Lindale; J. Travis Sparks, Flint, both of TX (US)

(73) Assignee: Star Lock Systems, Inc., Hilliard, OH (US)

( * ) Notice: Subject to any disclaimer, the term of this patent is extended or adjusted under 35 U.S.C. 154(b) by 0 days.

(21) Appl. No.: 09/371,633

(22) Filed: Aug. 11, 1999

Related U.S. Application Data

(60) Provisional application No. 60/096,251, filed on Aug. 12, 1998.

(51) Int. Cl.[7] ..... E05B 47/00

(52) U.S. Cl. ..... 70/277; 70/34; 70/386; 292/341.16

(58) Field of Search ..... 70/208, 275, 277, 70/283, 386, 34; 292/341.15, 341.16, 144, 201

(56) References Cited

U.S. PATENT DOCUMENTS

| | | | | |
|---|---|---|---|---|
| 1,262,435 | A | 4/1918 | Berg | |
| 1,499,444 | A | 7/1924 | Caillois | 24/155 |
| 2,727,772 | A | 12/1955 | Hamilton | 292/144 |
| 3,285,043 | A | 11/1966 | Dauenbaugh et al. | 70/208 |
| 3,753,316 | A | 8/1973 | Savarieau et al. | 49/31 |
| 3,911,534 | A | 10/1975 | Martens et al. | 24/150 |
| 3,919,869 | A | 11/1975 | Fromm | 70/263 |
| 3,947,930 | A | 4/1976 | Martens et al. | 24/155 |
| 3,994,521 | A | 11/1976 | Van Gompel | 292/319 |
| 4,157,534 | A | 6/1979 | Schachter | 340/147 |
| 4,438,962 | A | 3/1984 | Soloviff et al. | 292/144 |
| 4,637,234 | A | 1/1987 | Mielonen | 70/34 |
| 4,838,055 | A | 6/1989 | Gallagher | 70/208 |
| 4,899,561 | A | 2/1990 | Myers | 70/280 |
| 4,900,182 | A | 2/1990 | Stillwagon, et al. | 403/325 |
| 5,022,243 | A | 6/1991 | Embry et al. | 70/34 |
| 5,027,630 | A | 7/1991 | Stillwagon et al. | 70/391 |
| 5,140,317 | A | 8/1992 | Hyatt, Jr. et al. | 340/825.31 |
| 5,141,355 | A | 8/1992 | Stillwagon | 403/325 |
| 5,467,619 | A | 11/1995 | Stillwagon | 70/34 |
| 5,602,744 | A | 2/1997 | Meek et al. | 364/464.22 |
| 5,636,881 | A | 6/1997 | Stillwagon | 292/150 |
| 5,712,626 | A | 1/1998 | Andreou et al. | 340/825.31 |
| 5,746,458 | A | 5/1998 | Fisher | 292/252 |
| 5,808,558 | A | 9/1998 | Meek et al. | 340/870.01 |
| 5,813,257 | A | 9/1998 | Claghorn et al. | 70/208 |
| 6,005,487 | A | 12/1999 | Hyatt, Jr. et al. | 340/825.31 |

FOREIGN PATENT DOCUMENTS

| | | | |
|---|---|---|---|
| DE | 2633669 | 2/1977 | |
| EP | 117204 | 2/1984 | E05B/49/00 |

OTHER PUBLICATIONS

Medico Security Switch Locks Brochure

Inductors for Distributed Power Supplies —Siemens Matsushita Components —1995 pp. 1–3.

*Primary Examiner*—Suzanne Dino Barrett

(74) *Attorney, Agent, or Firm*—Womble Carlyle Sandridge & Rice PLLC

(57) ABSTRACT

An electro-mechanical latching apparatus for an enclosure such as a vending machine and including an electronic lock controller for disengaging a latch assembly securing the door of the enclosure against the enclosure frame in a closed, locked position. Upon actuation, the lock controller disengages the latch assembly and enable the door of the enclosure to be moved to an open position for accessing the enclosure.

14 Claims, 3 Drawing Sheets

ELECTRO-MECHANICAL LATCHING APPARATUS

CROSS REFERENCE TO RELATED APPLICATION

This application claims the benefit of U.S. Provisional Application Ser. No. 60/096,251, filed Aug. 12, 1998.

TECHNICAL FIELD

The present invention relates generally to latching and locking devices. In preferred embodiments, the present invention more specifically relates to electronic latching and locking devices such as for use with vending machines and similar enclosures.

BACKGROUND OF THE INVENTION

Latching or locking devices commonly are used to hold lids, doors or other closure elements of boxes, cabinets, doorways and other framed structures in closed and/or locked positions, and further typically are used to provide some measure of security against unauthorized or inadvertent access. For example, conventional vending machines generally include a key operated latch or locking device that typically includes a latching assembly and a post mounted to the frame and door of the vending machine so that the door of the vending machine is automatically locked when moved into a closed position against the machine frame by the insertion of the post into the latching assembly. Such latching assemblies further typically include a housing that defines an axial passage in which the post, often attached to and/or operating in conjunction with a T-handle, is received and is engaged by latch elements that are biased into contact with a surface of the post. The latch elements grip the post and preclude its withdrawal from the axial passage of the latch housing.

Typically, to disengage the latching assembly the post, these latching assemblies utilize key locks in which a key is received, and, as the key is turned, the biased latching elements of the assembly are released from engagement with the post to enable the door or other closure element to which the latch is mounted to be opened. Examples of such latching assemblies for use with vending machines or similar enclosures are disclosed in U.S. Pat. Nos. 5,050,413, 5,022,243 and 5,467,619. Such an unlocking or opening operation generally is a substantially manual operation such that most latching assemblies generally are limited in their placement to regions or areas where they can be readily reached and operated, i.e., in the middle of the door. Such easy access to these latching assemblies, however, tends to make these latching assemblies easy targets for vandals or thieves because they can shield their actions from view while attacking the security of the enclosure by picking or smashing the lock to remove the primary and sometimes only point of security between the door and the frame of the enclosure.

In particular, vending machines have become an increasingly favorite target of vandals and thieves. The popularity of vending machines has greatly increased in recent years, especially in remote areas for providing ready access to an increasing variety of goods including food and drinks, stamps, and higher priced items such as toys and cameras, all without requiring human intervention. At the same time, the capacities of conventional vending machines have increased significantly so as to not only provide consumers with more choices, thus creating more opportunities for sales, but further to decrease the amount of servicing or restocking that is required for the vending machines. For example, the typical soft drink vending machine has increased in capacity from approximately 420 cans to approximately 800 cans. The increased popularity and increased capacity of vending machines as well as the expansion of products to higher priced items have significantly increased the amounts of money taken in by vending machines, providing an increasingly attractive target to thieves and vandals. Further, if the key to one of these latching assemblies or locking devices is lost or stolen, all the locks accessible by such key must be "re-keyed" to maintain controlled access and security. Such re-keying is typically burdensome and very costly, especially where there are a significant number of locks that need to be re-keyed. Accordingly there is an increasing interest in improving the security of latching and locking assemblies for securing the doors or other closure devices of vending machines and similar enclosures.

There also exists a problem of monitoring and auditing the amount of time required for a service technician to access and service devices such as vending machines, automatic teller machines, gambling machines or other automated kiosks or containers. It is therefore difficult for many companies to develop a good schedule or concept of the total time required to service such vending devices or machinery to better plan service routes and/or allocate or assign service technicians. This problem is further compounded by conventional latching systems that require the post of the latch to be rotated through multiple revolutions to fully release it from the latch assembly. Such additional time required to disengage and open the latching assembly may seem small per individual machine, but constitutes a significant expenditure of time that can be burdensome, for example, for a company that has a large number of vending machines that must be serviced, by significantly increasing the amount of time required to service each particular vending machine.

There is, therefore, a need for improved latching systems and methods that address these and other related and unrelated problems.

SUMMARY OF THE INVENTION

Briefly described, the present invention generally comprises an electro-mechanical latching apparatus or system for securing a door or other closure device for enclosures such as vending machines, trailers, etc. The latching apparatus of the present invention is designed to provide enhanced security for the enclosure and to additionally provide for data collection and transfer of information to enable more accurate tracking of stocking information and service time. Typically, the enclosure to which the electro-mechanical latching apparatus of the present invention is applied will include an enclosure frame and at least one door hingedly attached to the enclosure frame so as to be movable between an unlocked, open position displaced from the enclosure frame and a closed, locked position secured against the enclosure frame.

The electro-mechanical latching apparatus generally includes a mechanical latch or lock assembly and an electronic lock control system or mechanism. The mechanical latch assembly secures the door against the enclosure frame and is disengaged or actuated through the electronic lock control system. The electronic lock control system or assembly is generally mounted on the inside of the door of the enclosure and controls the disengaging or releasing the handle assembly from a locked position to enable unlocking and thus opening of the door of the enclosure. The electronic lock control system preferably generally includes an electronic lock controller and an access device mounted to the front of the door. Typically, the lock controller includes a microprocessor and memory for storing data or information such as access codes, a capacitor and a relay switch. The access device can include a key lock or card swipe device for actuating the lock controller.

The mechanical latching assembly generally comprises a post latching assembly including a post mounted to the door of the enclosure and a latch mounted to the enclosure frame in a position to receive the post in locking engagement therein as the door is moved into its closed position against the enclosure frame. Generally, the post will include an elongated rod having a first end attached to the door and a second or distal end in which a notch is formed for engagement with the latch. In a first embodiment of the post latching assembly, the post includes a sloped notch portion and the latch includes a latch housing having an axial center passage in which the post is received and a retaining mechanism or element mounted within the housing and movable between a locked position in engagement with the post and an unlocked position for enabling release of the post from the latch. The retaining mechanism generally includes a detent assembly formed within the housing, and typically comprises a ball detent arrangement. The detent assembly generally includes a pair of holding balls positioned adjacent and biased inwardly toward engagement with the body of the retaining element by a pair of back stop balls positioned adjacent the holding balls along the outside periphery of the latch housing. Biasing elements such as compression springs bias and maintain the backstop balls in a lowered position in which the back stop balls in mm urge and hold the holding balls projecting into the axial center passage.

A latch element is pivotally mounted within the latch housing and includes a downwardly extending projection or flange adapted to engage and bear against the notched portion of the post when in a locking position. As the latch element is moved to its locking position, the latch element is engaged and held by the holding balls to hold the post in a locked position. An actuator, typically including a solenoid, is mounted adjacent the housing and includes a plunger connected to the housing for raising and lowering the solenoid with respect to the housing. Lift pins are received within channels formed through the housing and engage and urge the back stop balls against their biasing elements and out of engagement with the holding balls during an opening operation. As a result, the holding balls are released from engagement with the retention element to enable the retention element to be pivoted to its unlocked position and the post disengaged therefrom to open the door.

After the operator performs the desired tasks/operations for the enclosure, the operator records any additional data or programming information such as repair or work orders for the machine or stocking information into the key controller and thereafter closes and locks the door assembly of the enclosure.

Various objects, features and advantages of the present invention will become apparent to those skilled in the art upon reading the following detailed description, when taken in conjunction with the accompanying drawings.

DETAILED DESCRIPTION OF THE PREFERRED EMBODIMENTS

Figure 1:
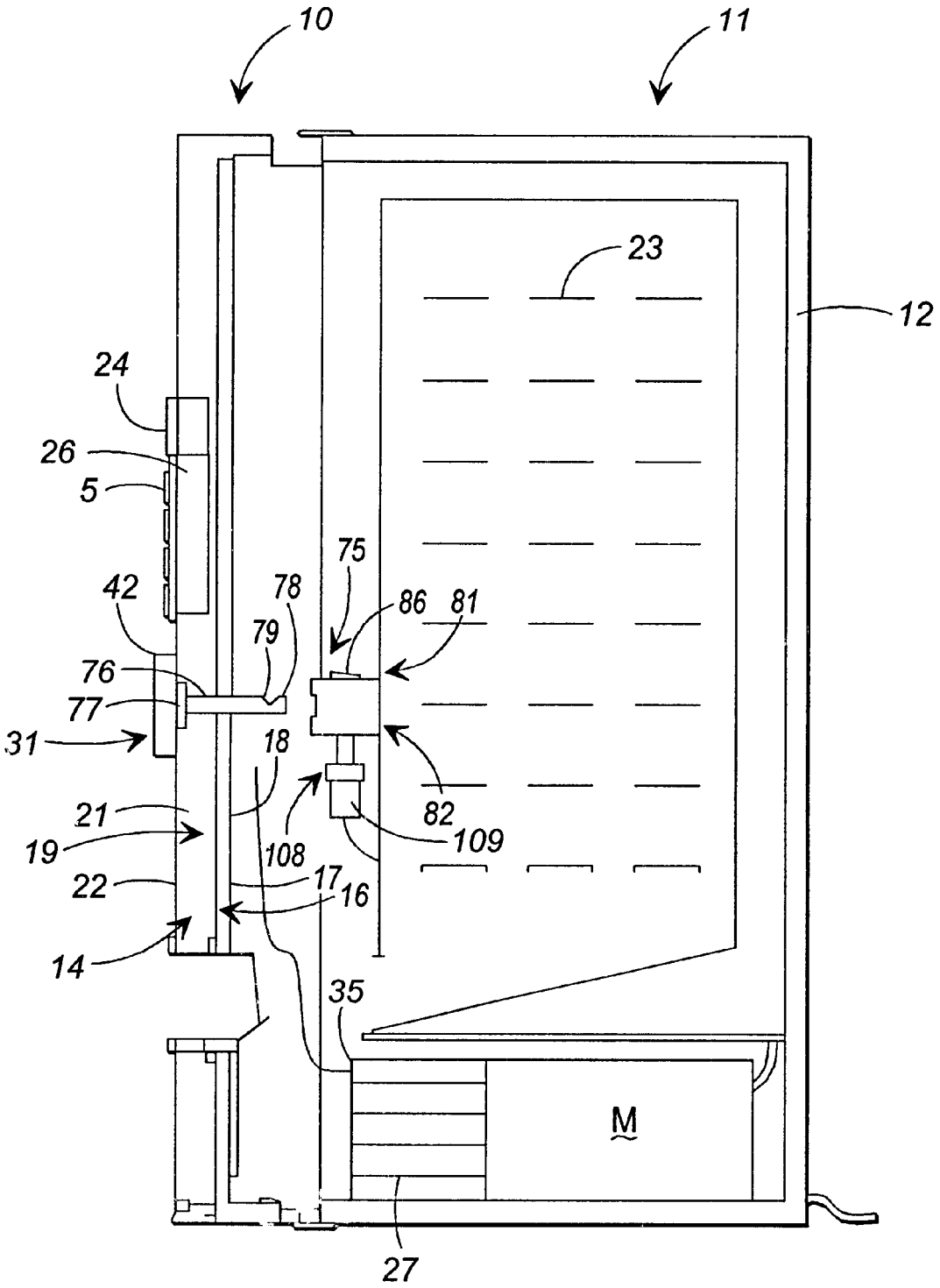
FIG. 1 is a side elevational view of the present invention of an electro-mechanical latching apparatus as applied to a vending machine in an exemplary embodiment.
Figure 2:
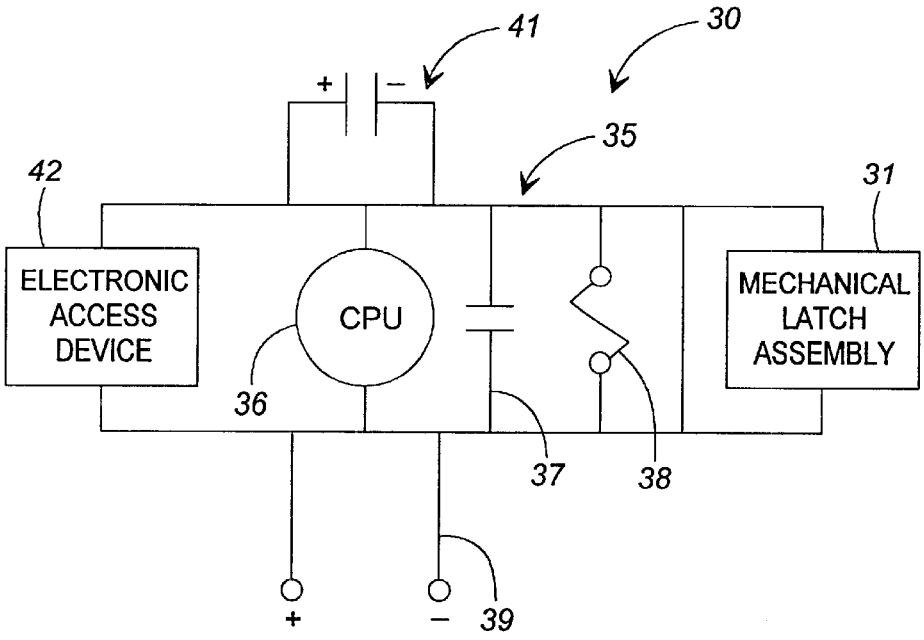
FIG. 2 is a schematic illustration of the circuit of the electronic lock control assembly of the present invention.
Figure 3:
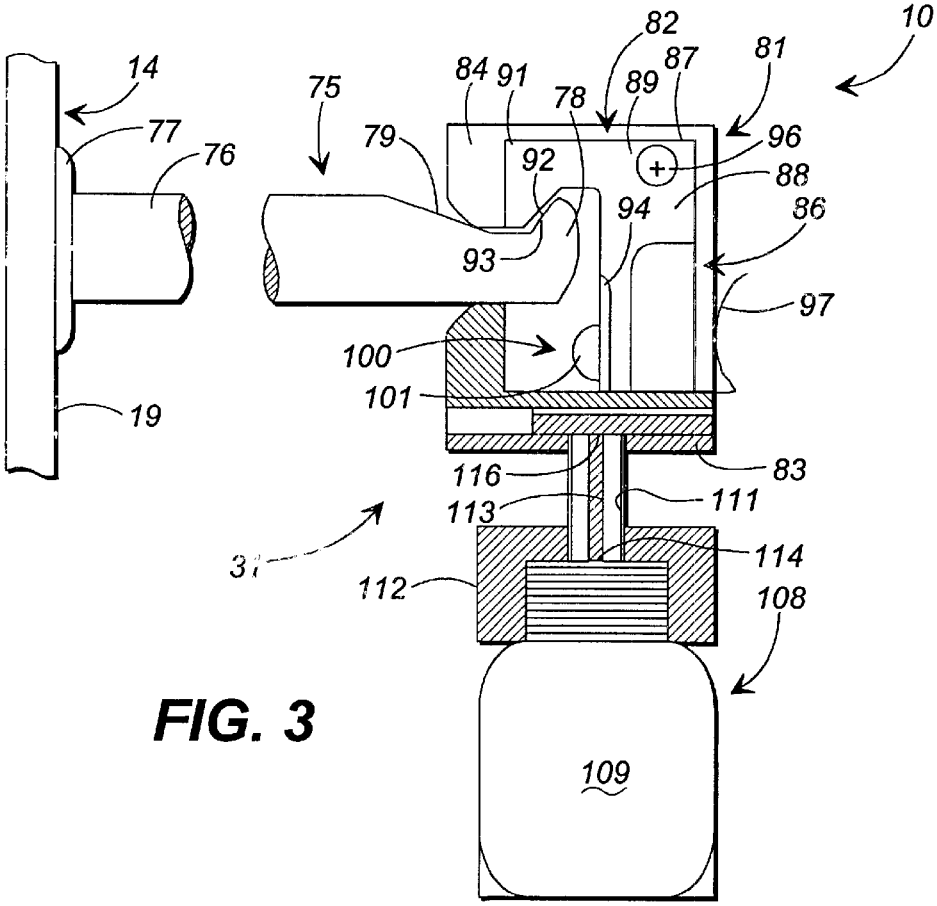
FIG. 3 is a side elevational view of the mechanical latch assembly with solenoid actuator.

Referring now to the drawings in greater detail in which like numerals indicate like parts throughout the several views, FIGS. 1–3 illustrate an electro-mechanical latching apparatus 10 for locking or securing and thus restricting access to an enclosure, as illustrated at 11 in FIG. 1, and which further enables recording and transfer of information and data between a control system for the enclosure and an operator key or control unit, such as who accessed the enclosure and at what times, and stocking data, etc. The enclosure 11 is generally illustrated in FIG. 1 as a vending machine such as a soft drink machine, for purposes of illustration. It will, however, be understood by those skilled in the art that the electro-mechanical latching apparatus 10 of the present invention can be applied to various types of enclosures including vending machines, automated teller machines, cabinets, storage units and other, similar types of enclosures.

Typically, the enclosure 11 will include a cabinet or body 12, frame 13 and a door assembly 14 hingedly attached to the frame so as to be movable between an unlocked, open position and a locked, closed position secured against the enclosure frame. In the case of a vending machine, as illustrated in FIG. 1, the door assembly typically will include an inner door 16, typically formed from an insulating material such as a foam material and having an outer frame 17 with a sealing gasket 18 formed from a flexible sealing material applied thereabout, and an outer door 19 which includes an outer frame 21 surrounding a door panel 22 that is formed from a somewhat translucent, durable plastic material such as LEXAN® and typically is inprinted with a design such as a product design or name, or which can be substantially transparent to enable viewing of the product contained within the enclosure. It will also be understood that a single door assembly, comprising a single door with spaced front and rear panels and a door frame, also can be used in place of the multiple door assembly illustrated in FIGS. 1 and 2. Further, in the case of a vending machine, the machine/enclosure generally will include product racks 23 for storing and supporting products, such as soft drinks or other food items, a motor M for operating the vending machine and dispensing products, a selector pad assembly S through which users can input desired product selections, and a coin or money reader 24 with a cash box 26 for receipt of monies for the selected products. The enclosure also typically will include a machine control 27 connected to an external power source, for processing user product requests and controlling the dispensing of products from the machine/enclosure.

The electro-mechanical latching apparatus 10 generally includes an electronic lock control system 30 and a mechanical latch or lock assembly 31 mounted to the outer door 19 and frame 13 of the enclosure 11, as illustrated in FIG. 1, for securing the doors in their locked position against the frame. The electronic lock control system communicates with and actuates or controls the mechanical latch assembly 31 for actuating or disengaging the latch assembly 31 to enable the inner and outer doors to be released and moved from their locked position against the frame 13 to their unlocked, open position for access to the enclosure cabinet.

As illustrated in FIG. 2, the electronic lock control system 30 generally includes an electronic lock controller 35 (FIGS. 1 and 2) typically mounted within the enclosure 11. The lock controller 35 generally includes a processor 36 such as a 64 to 128 bit microprocessor chip or board having internal memory and a clock, a capacitor 37 for storing power and generating a 40–50 volt DC pulse for activation of an actuator 115 of the latch assembly 31, and a relay 38 for transmitting power to and triggering the actuator. The lock controller generally is connected to a direct power source 39 such as a power outlet as is the machine controller 27 (FIG. 1). The lock controller communicates with the machine controller to transmit program updates and other information to the machine controller and receives data or information from the machine controller as to the operation of the enclosure such as a vending machine. In addition, a back-up battery 41 generally is provided for the lock controller, and typically comprises an approximately 12 volt, 1.5–2 amp battery, which provides back-up power to the lock controller 35 in the event that the direct power supply 39 is interrupted.

An electronic access device 42 generally is mounted to the front of the door assembly for the machine/enclosure and is connected to the lock controller 35. The electronic access device generally can include a variety of different types of access devices such as card swipe readers, proximity card readers which read an access card carried by the operator or service technician, a touch or key pad in which an access code generally is entered by the service technician or operator, a receiver unit which can receive signals, including access information, from a remote control unit carried by the service technician or operator, or a key assembly which sends an access control signal to the processor 36 of the lock controller 35 when a key in inserted and turned to indicate that the machine or enclosure has been accessed for disengaging the mechanical latch assembly to enable opening of the machine/enclosure.

Figure 4:
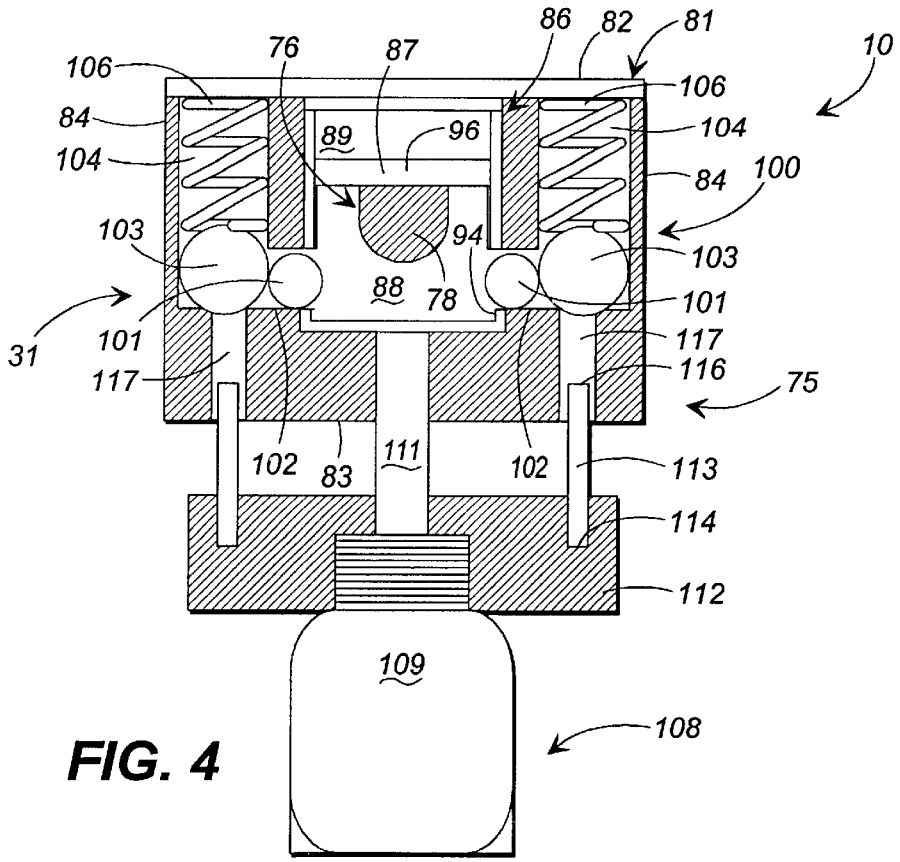
FIG. 4 plan view, taken in partial cross section, of the post latching assembly of FIG. 3 as the post is entering the latch housing.
Figure 5:
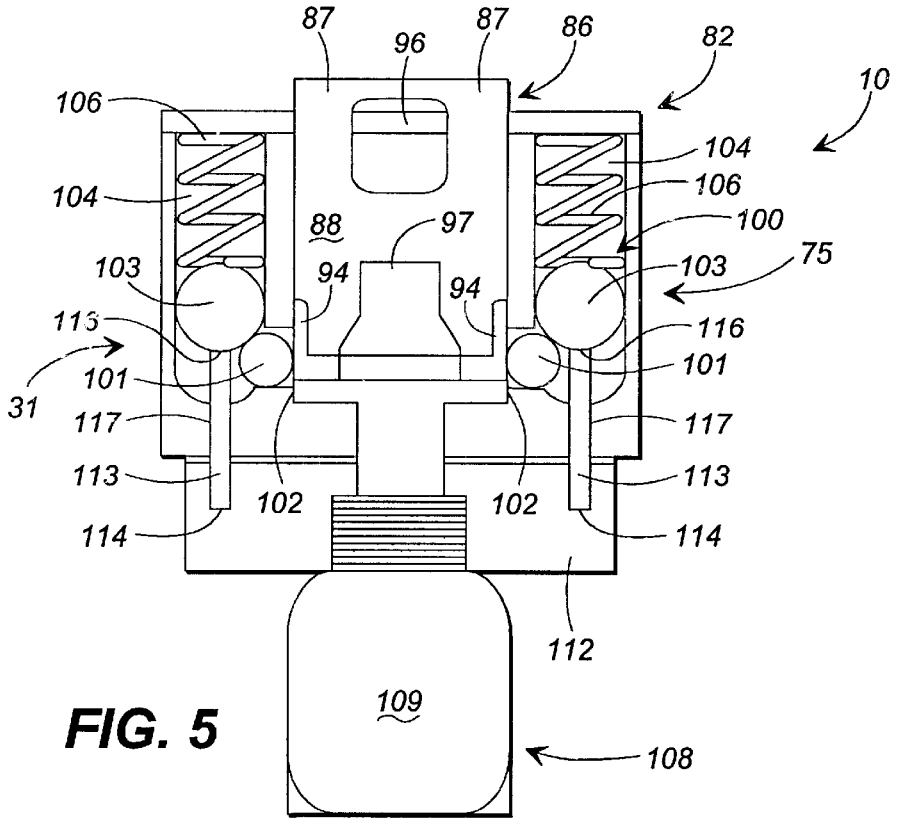
FIG. 5 is an end view taken in partial cross section of the post latching assembly of FIG. 3 in its locked position.

The mechanical latch assembly is shown in FIGS. 3–5, and generally comprises a post latching assembly 75. The latch assembly generally includes a post 76 mounted to the door assembly 14, as shown in FIG. 1, and generally is an elongated rod formed from a metal such as steel and includes a first, proximal end 77 mounted to the outer door and a second, distal end 78 that projects and is received through the inner door 16, with a notch 79 formed adjacent the distal end 78. A latch 81 is mounted to the enclosure frame in a position to receive the post in locking engagement therewith as the door assembly is moved to a closed position adjacent the enclosure frame. The latch 81 includes a housing 82 having a base portion 83 and a pair of upstanding side portions 84. The housing typically is formed from a hardened metal material such as steel or can be formed from other, similar durable high strength materials, and is mounted to the enclosure frame with mounting screws or similar fasteners (not shown).

A latch element 86 is pivotally mounted between the upstanding side portions 84 of the housing and includes a substantially L-shaped body 87 that includes a vertical portion 88 and a horizontally extending arm 89. As FIG. 5 illustrates, the arm 89 includes a downwardly extending projection or hooked portion 91 having a rearwardly sloped latching surface 92 formed along an inside surface thereof and which is adapted to engage and bear against the notch portion 79 of the post 76. In this embodiment, the notch portion 79 of the post generally is formed as a sloped notch having a sloped post retention surface 93 against which the latching surface 92 of the projection 91 engages and bears to hold the post in a locked position within the housing. The vertical portion 88 of the latch element 86 further includes recessed ball retention surfaces 94 formed along both sides thereof by which the latch element is engaged and held in a locked position. The latch element is adapted to engage and hold the post therein in locking engagement with the post received through the inner door 16 (FIG. 1) for locking the inner and outer doors against the frame 13.

As shown in FIGS. 3 and 5, a pivot pin 96 is extended through the latch element 86 approximately in the corner between the vertical and horizontal arm portions 88 and 89. The pivot pin enables the latch element to be pivoted from a locked position, as illustrated in FIGS. 3 and 4, in engagement with the post for locking the post within the latch housing, and an unlocked position illustrated in FIG. 5 in which the horizontal arm portion 89 of the latch element is pivoted upwardly and out of engagement with the notched portion of the post so as to release the post from the latch housing. A stop element 97 (FIGS. 3 and 5) is mounted to the base portion 83 of the housing 82, between the upstanding side portions 84 in a position to engage the vertical portion 88 of the latch element 97. The stop element typically comprises a leaf spring or similar resilient member that bears against and urges the latch element 86 forwardly and which provides a bearing surface against which the latch element 86 is urged as the post is received within the latch housing and engages the latch element 86 for locking the post within the latch housing.

As illustrated in FIG. 3, a detent assembly 100 is mounted within the upstanding side portions of the housing for engaging and holding the latch element in a locked position. The detent assembly 100 generally comprises a ball detent mechanism having a pair of holding balls 101 or bearings that are each received within and move along a horizontally extending holding ball passage 102 so as to be movable from a locked, engaging position, shown in FIG. 4, in which the holding balls engage and bear against the ball retention surfaces 94 of the latch element to a released, nonengaging position, shown in FIG. 5, releasing and enabling pivoting of the latch element to its unlocked position. A pair of back stop balls 103 or bearings are each received within a vertically extending back stop ball passage 104 and generally engage and bear against the holding balls 101 to urge the holding balls toward their engaging position as shown in FIG. 4. Biasing elements 106 such as compression springs are mounted within the back stop ball passages 104, typically positioned above the back stop balls. The biasing elements exert a biasing force downwardly against the back stop balls 103 to urge the back stop balls into a lowered position seated at the lower end of the back stop ball passages. In this position, the back stop balls urge and maintain the holding balls in engagement with the ball retention surfaces 94 formed along the vertical portion 88 of the latch element 86 as illustrated in FIG. 4. As a result, the latch element 86 is held in its locked, engaging position to prevent release of the post 75 and thus to prevent opening of the door and access to the enclosure.

As shown in FIGS. 3–5, an actuator 108 is mounted to the latch housing for disengaging the detent assembly and enabling the latch element to be moved from its locked position to its unlocked position for release of the post therefrom. The actuator typically comprises a solenoid 109 that generally is a 24 volt solenoid having at least 0.9 ohm resistance such as manufactured by Guardian Electric, Inc. The solenoid 109 includes a plunger 111 that is mounted to the base 83 of the housing 82 as illustrated in FIGS. 3–5. As the solenoid is actuated, it retracts its plunger, which causes the solenoid to be raised toward the latch housing. A pusher plate or pad 112 is mounted at the upper end of the solenoid, with the plunger 111 extending therethrough and extends laterally to a width slightly less than the width of the latch housing. The pusher pad typically is formed from a plastic or similar material and received and supports a pair of lift pins 113 adjacent its outer edges. The lift pins generally are metal pins or rods each having a first end 114 mounted to the pusher pad 112 and a second end 116 that projects into the base of the latch housing along lift pin guide passages 117 into the back stop ball passages 104. Thus, as the solenoid is raised, it moves the pusher pad toward the latch housing, causing the lift pins to be moved along the lift pin guide passages and into engagement with the back stop balls to release the holding balls from their locking engagement with the latch element.

Typically, in use of the electro-mechanical latching apparatus 10 (FIG. 1), the operator or service technician engages the electronic access device such as by swiping an access card through a card swipe reader or proximity sensor, or by inputting or transmitting an access code or identification code. The electronic access device transmits the access or identification information for the operator to the lock controller 35. This access information is compared with stored identification or access codes stored within the processor 36 of the lock controller. If the inputted access or identification code is not recognized as being authorized, access to the machine or enclosure is denied. If the inputted access or identification code is recognized as authorized to access the enclosure, a power signal is generated in the capacitor 37 and is transmitted by the processor 36 through the relay 38 to actuate the solenoid or other actuator of the mechanical latching assembly 31.

As the solenoid is actuated and the pusher pad accordingly is raised toward the base of the housing, the lift pins are moved along the guide passages 117 so that their second ends 116 engage and urge the back stop balls upwardly against the biasing elements 106 and out of locking engagement with the holding balls 101, as illustrated in FIG. 5. As the back stop balls are raised from direct side-to-side engagement with the holding balls, the holding balls 101 are released from their locking engagement with the ball retention surfaces 94 of the latch element 86 so as to allow the latch element to be pivoted to its raised, unlocked position to release the post from engagement therewith. Once the post has been released from its locking engagement within the latch housing, the resilience of the flexible sealing gasket 18 (FIG. 1) applied about the inner door 16 typically tends to urge the doors away from the frame 13 and thus move the post out of the latch housing to enable the doors 16 and 19 to be moved from to an open position displaced from the enclosure frame. Thereafter, the operator or service technician can move the doors to their fully opened position for servicing the machine/enclosure. Once the service technician has completed restocking or other servicing of the machine/enclosure, the technician moves the doors to their closed position with the post 76 received within the latch 81 to lock the door in its closed, locked position.

The present invention thus provides more enhanced security of enclosures such as vending machines, ATMs or similar types of enclosures by providing an electronically operated latching assembly through which access to the machines/enclosures can be tightly controlled, and which further enables information regarding the servicing of such machines/enclosures to be monitored and reported to enable businesses to service such machines/enclosures more efficiently and to reduce or minimize down time and losses.

It will be understood by those skilled in the art that while the foregoing invention has been disclosed with reference to preferred embodiments or features, various modifications, changes and additions can be made to the foregoing invention, without departing from the spirit and scope of the invention as set forth in the following claims.

What is claimed is:

1. A latching assembly for securing a door against a door frame, comprising:

a post mounted to the door;

a latch mounted to the door frame in a position to be engaged by said post as the door is moved toward a closed position against the door frame and including a housing and a latch element pivotally mounted within said housing for engaging and holding said post within said latch, said latch element being movable between a latch-locked position engaging said post and a latch-unlocked position enabling said post to be released and removed from said latch;

a detent assembly including at least one holding ball and a back stop ball which urges said holding ball into engagement with said latch element for holding said post in a post-locked position within said latch, and including a biasing element positioned to engage and urge said back stop ball against said holding ball;

an actuator including a solenoid communicating with said latch element moving said latch element from the latch-locked position to the latch-unlocked position for releasing said post from said latch and permitting the door to be moved to an open position displaced from the door frame; and an electronic lock control for controlling said actuator to disengage said latch element.

2. A latching assembly for securing a door against a door frame, comprising:

a post mounted to the door;

a latch mounted to the door frame in a position to be engaged by said post as the door is moved toward a closed position against the frame and including a housing and a latch element pivotally mounted within said housing for engaging and holding said post within said latch, said latch element being movable between a latch-locked position engaging said post and a latch-unlocked position enabling said post to be released and removed from said latch;

a detent assembly including at least one holding ball which urges said holding ball into engagement with said latch element for holding said post in a post-locked position within said latch, and including a biasing element positioned to engage and urge said back stop ball against said holding ball;

an actuator including a solenoid communicating with said latch element moving said latch element from the latch-locked position to the latch-unlocked position for releasing said post from said latch and permitting the door to be moved to an open position displaced from the door frame, a plunger connected to said housing and drawing said solenoid toward said housing as said plunger is retracted by said solenoid, and at least one lift pin movable with said solenoid for engaging said back stop ball to urge said back stop ball from engagement with said holding ball; and an electronic lock control for controlling said actuator to disengage said latch element.

3. A latching assembly for securing a door against a door frame, comprising:

a post mounted to one of a door and a frame;

a latch mounted to the other of the door and the frame in a position to be engaged by said post as the door is moved toward a closed position against the frame and including a housing and a latch element pivotally mounted within said housing for engaging and holding said post within said latch, said latch element being movable between a latch-locked position engaging said post and a latch-unlocked position enabling said post to be released and removed from said latch;

a detent assembly including at least one holding ball and a back stop ball which urges said holding ball into engagement with said latch element for holding said post in a post-locked position within said latch and including a biasing element positioned to engage and urge said back stop ball against said holding ball;

an actuator including a solenoid communicating with said latch element moving said latch element from the latch-locked position to the latch-unlocked position for releasing said post from said latch and permitting the door to be moved to an open position displaced from the frame; and an electronic lock control for controlling said actuator to disengage said latch element.

4. The latching assembly of claim 3 and wherein as the holding ball holds the post in the post-locked position, the back stop ball completely obstructs linear movement of the holding ball away from the post in a direction perpendicular to a length of the post.

5. The latching assembly of claim 3 and wherein said electronic control lock comprises:

an electronic lock controller for controlling the release of said locking element, and an access device for transmitting control signals to said lock controller to cause the release of said latch element from said post.

6. The latching assembly of claim 5 and wherein said access device includes a key lock.

7. A latching assembly for securing a door against a door frame, comprising:

a post mounted to one of the door and the door frame;

a latch mounted to the other of the door and the door frame in a position to be engaged by said post as the door is moved toward a closed position against the frame and including a housing and a latch element pivotally mounted within said housing for engaging and holding said post within said latch, said latch element being movable between a latch-locked position engaging said post and an latch-unlocked position enabling said post to be released and removed from said latch;

a detent assembly including at least one holding ball and a back stop ball which urges said holding ball into engagement with said latch element for holding said post in a post-locked position within said latch and including a biasing element positioned to engage and urge said back stop ball against said holding ball;

an actuator including a solenoid communicating with said latch element moving said latch element from the latch-locked position to the latch-unlocked position for releasing said post from said latch and permitting the door to be moved to an open position displaced from the door frame, a plunger connected to said housing and drawing said solenoid toward said housing as said plunger is retracted by said solenoid, and at least one lift pin movable with said solenoid for engaging said back stop ball to urge said back stop ball from engagement with said holding ball; and an electronic lock control for controlling said actuator to disengage said latch element.

8. The latching assembly of claim 7 and wherein as the holding ball holds the post in the post-locked position, the back stop ball completely obstructs linear movement of the holding ball away from the post in a direction perpendicular to a length of the post.

9. A latching apparatus for securing a door to a door frame of an enclosure, comprising:

a latch assembly having a post mounted to one of the door and the door frame and a latch mounted to the other of the door and the door frame, said latch assembly being positioned to receive said post therein to secure the door to the door frame in a locked position;

said latch including a latch element pivoting to engage said post and a detent assembly having at least one holding ball biased into engagement with said latch element and a solenoid for disengaging said holding ball to release said latch element from engagement therewith; and an electronic lock control system including a lock controller communicating with said latch assembly for actuating said solenoid to cause said holding ball to be released from engagement with said latch element and an access control device communicating with said lock controller for causing said lock controller to actuate said solenoid in response to access information from said access control mechanism.

10. The latching apparatus of claim 9 and wherein said detent assembly further comprises a back stop ball biased into engagement with said at least one holding ball for urging said at least one holding ball into a locking position engaging and holding said post within said housing.

11. The latching apparatus of claim 9 and wherein said access control device comprises a card reader.

12. The latching apparatus of claim 9 and wherein said access control device includes a key lock.

13. The latching apparatus of claim 9 and further including a stop member positioned adjacent said latch element for biasing said latch clement toward an unlocked position.

14. The latching apparatus of claim 10 and wherein as the holding ball is in the locking position, the back stop ball completely obstructs linear movement of the holding ball away from the post in a direction perpendicular to a length of the post.

* * * * *